United States Patent [19]

Lord

[11] 4,152,203

[45] May 1, 1979

[54] METHOD OF WARPAGE CONTROL FOR MOLDED FIBER TRAYS

[75] Inventor: Henry A. Lord, Cape Elizabeth, Me.

[73] Assignee: Diamond International Corporation, New York, N.Y.

[21] Appl. No.: 860,931

[22] Filed: Dec. 15, 1977

Related U.S. Application Data

[63] Continuation of Ser. No. 718,190, Aug. 27, 1976, abandoned.

[51] Int. Cl.[2] ..... B29J 5/04; D21J 1/04; D21J 1/06; D21J 3/10

[52] U.S. Cl. ..... 162/223; 162/224; 162/227; 162/228; 264/324

[58] Field of Search ..... 162/56, 221, 223, 227, 162/228, 224, 231; 229/2.5 R; 264/324

[56] References Cited

U.S. PATENT DOCUMENTS

| | | | |
|---|---|---|---|
| 2,939,602 | 6/1960 | Grant | 229/2.5 R |
| 2,996,118 | 8/1961 | Chaplin | 162/223 |
| 3,284,917 | 11/1966 | Foote | 162/224 |
| 3,477,908 | 11/1969 | Daniele | 162/223 |
| 3,845,896 | 11/1974 | Crabtree | 229/2.5 R |

*Primary Examiner*—W. E. Hoag
*Attorney, Agent, or Firm*—Karl W. Flocks

[57] ABSTRACT

Method of eliminating warpage of molded fiber trays during free drying by pressing the back side of the preform where ribs cross with a dimpling projection on a rubber insert in a pressure head on a molding machine.

4 Claims, 5 Drawing Figures

METHOD OF WARPAGE CONTROL FOR MOLDED FIBER TRAYS

This is a continuation of application Ser. No. 718,190, filed Aug. 27, 1976 and now abandoned.

BACKGROUND OF THE INVENTION

This invention relates to the free drying in an oven of molded fiber trays used for the display and sale of food and other products and particularly the way to control the characteristic arch warpage of this product.

The exact reason for such warpage is not fully known but one speculation is that warpage has occurred from the intersection drying differential between the rib tops and bottoms. This arching may be pronounced in molded fiber products containing latticed bottom panels.

The warpage of molded fiber products has been a problem for many years since the generally used molded products for display and sale of food has had this drawback of warping during free drying. This problem is described in U.S. Pat. No. 2,704,493 of Randall, granted Mar. 22, 1955, and entitled "Molded Pulp Articles and Process of Manufacture". In that patent an attempt was made to cope with this problem of warpage by a method of molding, free drying, and then attempting to press the article back into shape to remove the warping due to free drying.

A later patent relating to warpage control in a display tray which refers specifically to food trays which are of interest further discusses the material of the molded pulp food trays and their warpage. This is U.S. Pat. No. 3,929,564 of Reifers, granted Dec. 30, 1975, and entitled "Method of Molding Free Dried Pulp Display Tray" which discloses the making of a free dried, molded pulp tray with an indented peripheral margin which is formed during the molding of the tray.

U.S. Pat. No. 1,900,427 of Clapp, granted Mar. 7, 1933, and entitled "Manufacture of Fibrous Articles" also recognized the warpage problem and mentioned that drying may be effected between heated dies under pressure to effect a compacting of the product which was discussed in U.S. Pat. No. 2,704,493 of Randall introduced above, as an expensive process as opposed to the less expensive method involving free drying. Therefore Clapp in U.S. Pat. No. 1,900,427, further stating that articles moulded from ordinary paper pulp such as, for example, ground-wood pulp generally tend to warp badly and lose their shapes, has attempted to overcome warpage by incorporating materials such as asbestos fiber into the paper pulp which material incidentally would now be prohibited for use where food products are involved.

Warpage of molded food trays of the fibrous material generaly used for the molding of such trays has been a recognized problem for many years but the present invention discloses a method which does not require a change in composition of the fibrous molded material nor the elimination of free drying.

SUMMARY OF THE INVENTION

A means to control warpage of molded fiber products during drying through use of an insert in the pressure head of a molding machine having projections thereon for wet pressing dimples into the rib junctions of the molded fiber product.

A method to control warpage during drying of molded fiber products by wet pressing dimples into rib junctions of the molded fiber product before free drying the product.

An object of the present invention is to effect reduction or elimination of belly and/or end and side arch for molded fiber products and especially those containing a latticed bottom panel.

An advantage of the present invention is that oven drying of molded fiber products becomes less critical in the drying parameters and thus these articles can be manufactured more economically.

Therefore, this invention allows the making of flatter articles of molded fiber with less critical control during drying.

BRIEF DESCRIPTION OF THE DRAWINGS

The above and other objects and advantages inherent in the present invention will become apparent from the following description with the accompanying drawings in which.

DESCRIPTION OF THE PREFERRED EMBODIMENTS

Figure 1:
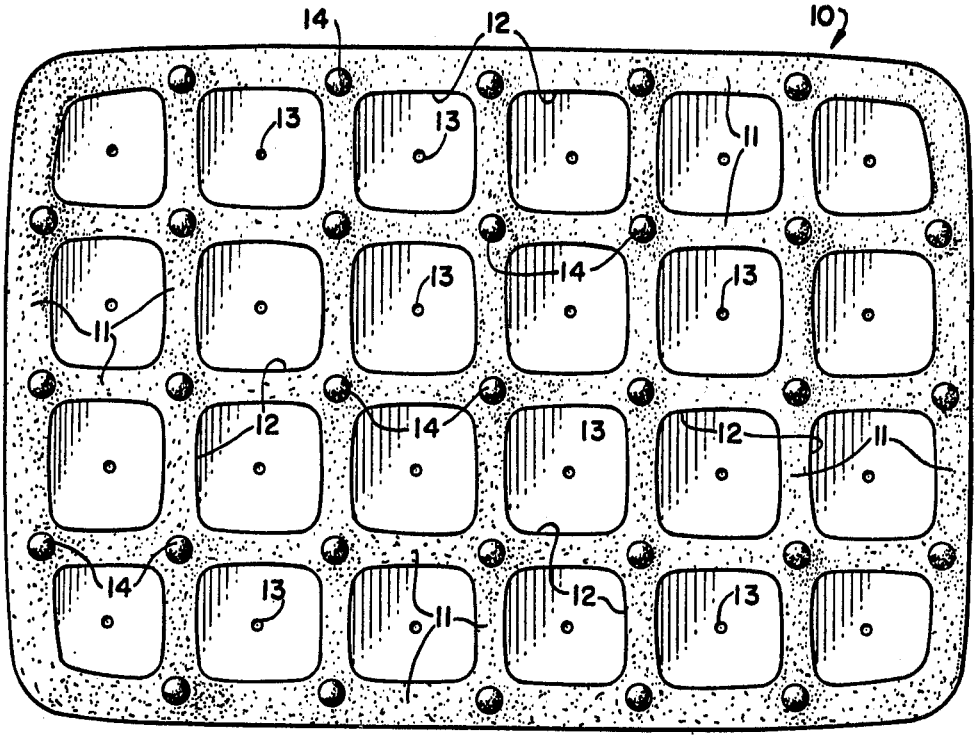
FIG. 1 illustrates the face side of a rubber pressure head insert.
Figure 2:
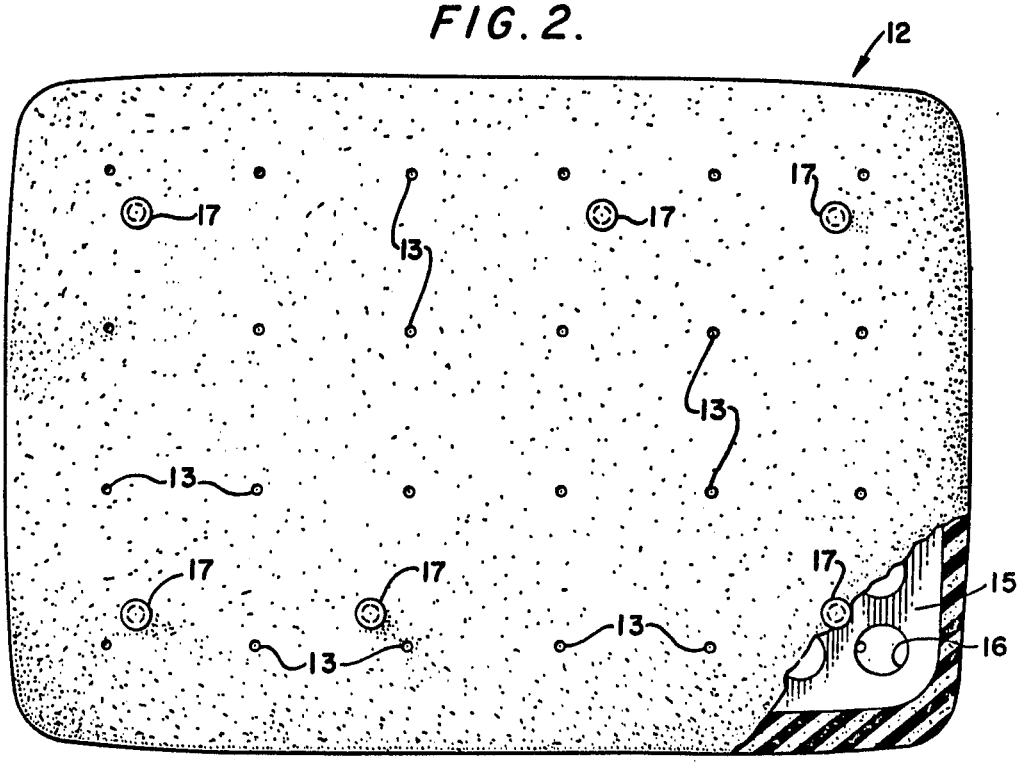
FIG. 2 shows the back side of the rubber pressure head insert of FIG. 1.
Figure 3:
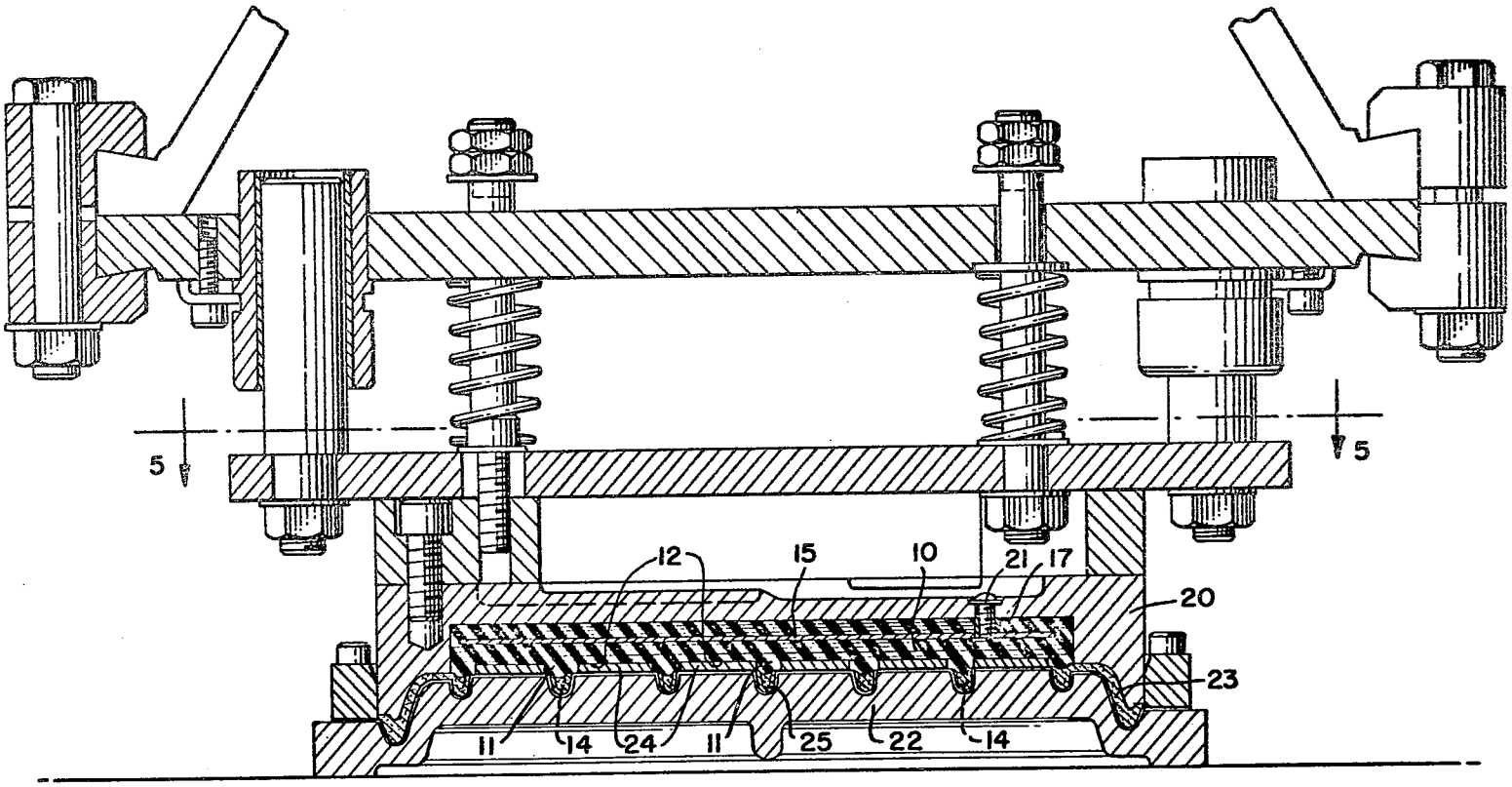
FIG. 3 shows a front elevational sectional view of a pressure head and mold assembly containing the rubber pressure head insert of FIGS. 1 and 2 with the section shown taken along line 3—3 of FIG. 4.
Figure 4:
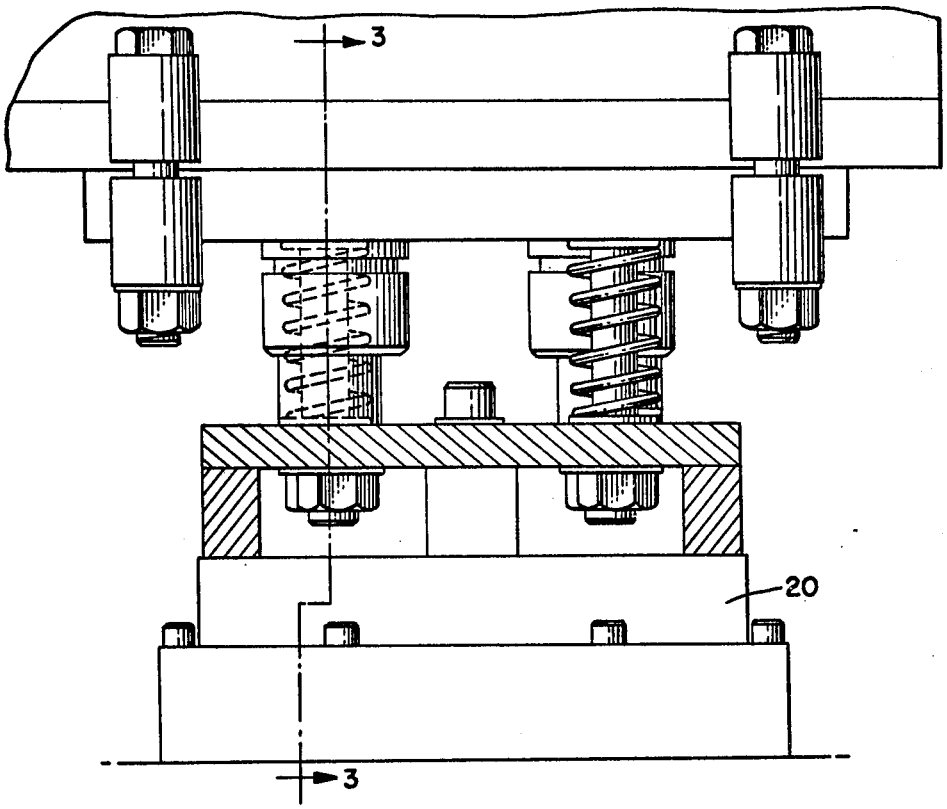
FIG. 4 is a partial side view of the pressure head and mold assembly of FIG. 3.
Figure 5:
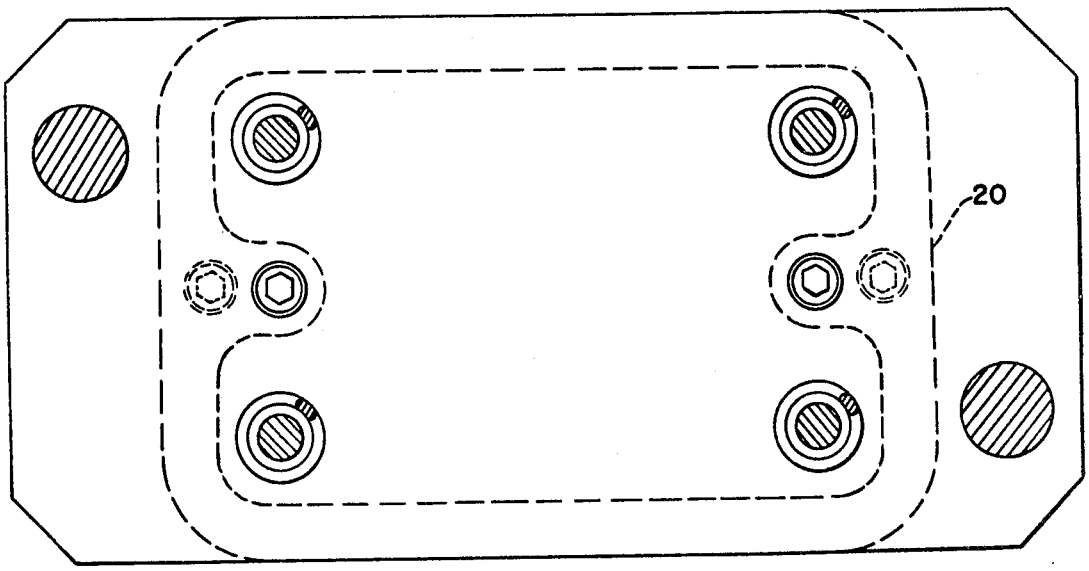
FIG. 5 is a view along line 5—5 of FIG. 3.

FIGS. 1 and 2 show the face and back sides, respectively, of a rubber pressure head insert 10 used in the pressure head 20 of a machine illustrated partially in FIGS. 3-5.

The rubber pressure head insert 10 illustrated here is specially used in the production of a molded fiber tray having a latticed bottom. Although the invention is not to be limited to use in the manufacture of the latticed bottom product, such type of mold is illustrated here because of the additional problems encountered in the forming and drying of such products.

On the face side in FIG. 1, there is shown rib portions 11 of pressue head insert 10 defining substantially square flat depressions 12 with air holes 13 substantially centered in depressions 12 and extending through pressure head insert 10 as illustrated again in FIG. 2.

At the intersections or junctions of rib portions 11 on the face side of pressure head insert 10 are raised ribs or projections 14. These projections are illustrated as truncated conical shapes but other shapes may be used. Shapes being used may resemble the shape of the area being dimpled. Shapes may include projections as pyramids or crosses or some other form. The size of projection 14 has been found to work best when it is designed to wet press the area being dimpled to a calipered thickness in the range of 0.050 of an inch to 0.065 of an inch.

Although the projection 14 is illustrated as part of the rubber pressure head insert and can be formed of rubber, it has been found that good warpage control is also obtained if the projection is of metal.

As illustrated in the broken away portion of FIG. 2, a brass or other metal reinforcing core plate 15 is embedded in the center layer of the rubber pressure head insert 10 to stiffen the rubber insert. This is also illustrated in the sectional view of the rubber pressure head insert 10 in FIG. 3. This core plate 15 is perforated with holes 16 and also has rivets 17 attached to it and extending through the back side of rubber pressure head insert 10. Rivets 17 are internally threaded and receive machine screws 21 therein to attach rubber pressure head insert 10 to pressure head 20.

The rubber pressure head insert 10 should be of a harder form of rubber and an insert cast from General Electric RTV60 silicone with a Shore A Durometer of 60 has worked well in one embodiment.

Referring again to FIGS. 3–5, there is shown the pressure head and mold assembly in which rubber pressure head insert 10 is installed with insert 10 held in a cavity in pressure head 20 by machine screws 21, only one of which is shown. The lower face (in FIG. 3) of insert 10 with rib portions 11 and projections 14 projecting therefrom faces lower mold 22 having a complementary design to pressure head 20 and its insert 10. The material to form molded fiber tray 23 is compressed between lower mold 22 and rubber pressure head insert 10 and the edge portions of pressure head 20. Since molded fiber tray 23 illustrated here is of the type having a latticed bottom, there are window blockouts 24 located in depressions 12 of insert 10 as shown between ribs 25 of the molded fiber tray 23, with projections 14 located so as to dimple the underside of ribs 25 at their junctures with cross ribs.

The remainder of the pressure head and mold assembly which is partially illustrated in FIGS. 3–5 is well known in the art and does not require further description here.

After the molding of the molded fiber tray 23, and the dimpling by pressure head insert 10 as discussed above, the tray 23 is removed from the molding machine and dried in an oven or as usual in this art. But due to the dimpling having taken place as discussed above, the conditions for free drying are not as critical as in the past and warpage of the tray is thus controlled and/or eliminated.

Also, it should be noted that projections 14 may be of rubber or metal and may or may not be integral with the surface layer or core of the insert 10. With this in mind it must be understood that it is within the present invention to use a metal insert wherein the projections are both metal and integrally formed with the surface. Consideration should be given to the location and size of the projections in accordance with caliper of the material at these dimpled portions so as to form a uniform material section at those points to have more uniformity of moisture there and thus stabilize the tray which is being centered into the dryer.

It will be obvious to those skilled in the art that various changes may be made without departing from the scope of the invention and the invention is not to be considered limited to what is shown in the drawings and described in the specification.

What is claimed is:

1. A method of controlling warpage of molded fiber products usually subject to warpage during free drying such as molded material used for trays for food products and the like, consisting essentially of the successive steps of accretion molding a fiber product used for food products and the like, after the molding step, wet pressing discrete dimples into the underside of the molded fiber product to a distance approaching but not passing the upper surface of the molded fiber product at locations of thicker fiber product to reduce the thickness of the fiber product to a distance approaching the thickness of the product at locations of thinner fiber product, removing the molded fiber product from the press, and free drying the molded fiber product.

2. A method of controlling warpage of molded fiber products usually subject to warpage during free drying such as molded pulp used for trays for food products and the like, consisting essentially of the successive steps of accretion molding a fiber product having ribs integrally joined to each other at junctions where the ribs cross, using a fiber material ordinarily used for trays for food products and the like which is subject to warpage during the step of free drying, applying a pressure head in a press to said accretion molded fiber product to wet press discrete dimples into the underside of the rib junctions of the already molded fiber product to a distance approaching but not passing the upper surface of the rib whereby the fiber product on the inside of the ribs is compressed to reduce the thickness of the walls of the ribs by the pressing of the dimples into the rib functions, removing the molded fiber product from the press, and free drying the molded fiber product.

3. The method of claim 2, further characterized by performing the step of wet pressing until the thickness of the fiber product in the area of the dimple on the molded fiber product is less than 0.065 of an inch.

4. The method of claim 2, further characterized by performing the step of wet pressing until the thickness of the fiber product in the area of the dimple on the molded fiber product is in the range of 0.050 to 0.065 of an inch.

* * * * *